US008739377B2

(12) United States Patent
Shen

(10) Patent No.: US 8,739,377 B2
(45) Date of Patent: Jun. 3, 2014

(54) TOOL DEVICE FOR DISMANTLING BEARING ELEMENT

(76) Inventor: Wei Nan Shen, Taichung (TW)

( * ) Notice: Subject to any disclaimer, the term of this patent is extended or adjusted under 35 U.S.C. 154(b) by 839 days.

(21) Appl. No.: 12/928,587

(22) Filed: Dec. 15, 2010

(65) Prior Publication Data

US 2012/0151728 A1 Jun. 21, 2012

(51) Int. Cl.
*B25B 1/00* (2006.01)
*B25B 1/24* (2006.01)
*B25B 27/073* (2006.01)

(52) U.S. Cl.
USPC ..... 29/260; 29/274

(58) Field of Classification Search
CPC ..... B25B 27/023; B25B 27/062; B25B 27/02
USPC ..... 29/260, 259, 724, 156, 46
See application file for complete search history.

(56) References Cited

U.S. PATENT DOCUMENTS

| | | | | | |
|---|---|---|---|---|---|
| 1,482,694 | A * | 2/1924 | Neill | 29/261 |
| 1,725,169 | A * | 8/1929 | Wooldridge | 29/261 |
| 2,484,129 | A | 10/1949 | Taylor | |
| 3,568,294 | A * | 3/1971 | Conner | 29/259 |
| 3,579,795 | A | 5/1971 | Burman | |
| 3,880,604 | A | 4/1975 | Hawkins | |
| 4,771,528 | A * | 9/1988 | Stromberg | 29/259 |
| 4,916,791 | A | 4/1990 | Clouse et al. | |
| 4,989,311 | A * | 2/1991 | Rosin | 29/259 |
| 4,989,312 | A * | 2/1991 | Maddalena | 29/259 |
| 5,177,848 | A * | 1/1993 | Halstead | 29/246 |
| 6,665,918 | B1 * | 12/2003 | Williams | 29/259 |
| 7,216,409 | B1 * | 5/2007 | Chiu et al. | 29/259 |
| 7,272,886 | B2 * | 9/2007 | Thomson | 29/724 |
| 7,699,847 | B2 * | 4/2010 | Sheldon et al. | 606/53 |
| 7,770,277 | B2 * | 8/2010 | Wridt | 29/261 |
| 8,517,365 | B2 * | 8/2013 | Velez | 269/156 |
| 2006/0053609 | A1 * | 3/2006 | Wridt | 29/261 |

* cited by examiner

*Primary Examiner* — Lee D Wilson
*Assistant Examiner* — Alvin Grant
(74) *Attorney, Agent, or Firm* — Charles E. Baxley

(57) ABSTRACT

A tool device includes a support lever having a middle screw hole and having two side open channels, a pressing member having an outer thread for engaging with the screw hole of the support lever and having a center member pivotally attached to the inner end portion for engaging with the object, and two connecting levers each having a tongue formed in an inner end portion for engaging with the bearing element to be removed and each having an outer end portion engageable into the channel of the support lever, and each having an enlarged head for anchoring the support lever to the element and the object, and for allowing the element to be pulled and removed from the object with the pressing member.

2 Claims, 5 Drawing Sheets

TOOL DEVICE FOR DISMANTLING BEARING ELEMENT

BACKGROUND OF THE INVENTION

1. Field of the Invention

The present invention relates to a tool device, and more particularly to a tool device for dismantling or disengaging an oil seal and/or bearing element from a vehicle part or machine element or object or the like and for allowing the bearing element to be easily dismantled or disengaged from the vehicle part or machine element or object by the users themselves.

2. Description of the Prior Art

Typical vehicle parts or machine elements or objects comprise a bearing element rotatably received or engaged in a socket or housing. Normally, the socket or housing includes a solid structure for stably receiving the bearing element and for preventing the bearing element from being removed or disengaged from the socket or housing particularly when the bearing element is rotated in a great speed relative to the socket or housing.

When the typical vehicle parts or machine elements have been damaged or when the bearing element has been worn out, it will be difficult to remove or disengage the bearing element from the socket or housing, particularly may not be easily removed or disengaged from the socket or housing by the users themselves. In addition, a number of different tool members or tool devices are required to be purchased and prepared to remove or disengage the bearing element from the socket or housing.

For example, U.S. Pat. No. 2,484,129 to Taylor, U.S. Pat. No. 3,579,795 to Burman, U.S. Pat. No. 3,880,604 to Hawkins, and U.S. Pat. No. 4,916,791 to Clouse et al. disclose several of the typical puller devices or removing tools or presses for loosening or removing oil seals and/or bearing elements from a vehicle part or machine element or the like and comprise a support body for supporting the sockets or housings of the bearing eyes, and one or more spacer members for moving or separating the ears of the sockets or housings of the bearing eyes from each other and for removing or disengaging the bearing element from the sockets or housings of the bearing eyes.

However, the sockets or housings of the bearing eyes may include different widths or thicknesses, and the gripping or grasping jaws or pawls have a predetermined spacing distance such that the gripping or grasping jaws or pawls of the support body may not be used for supporting the sockets or housings of the bearing eyes of different widths or thicknesses.

The present invention has arisen to mitigate and/or obviate the afore-described disadvantages of the conventional tool devices for removing or disengaging the bearing elements from the sockets or housings.

SUMMARY OF THE INVENTION

The primary objective of the present invention is to provide a tool device for easily and quickly removing or disengaging the bearing elements from the sockets or housings of the vehicle parts or machine elements or objects when required.

The other objective of the present invention is to provide a tool device for easily and quickly removing or disengaging the bearing elements from the sockets or housings of the ball joints or universal joints when the sockets or housings or the bearing elements include different sizes or dimensions or widths.

In accordance with one aspect of the present invention, there is provided a tool device for dismantling an element from a housing of an object, the tool device comprising a support lever including a middle portion having a screw hole formed therein, and including two side portions each having a channel formed therein and opened outwardly for forming an outer opening, a pressing member including an outer thread for engaging with the screw hole of the support lever and including an inner end portion, a center member pivotally attached to the inner end portion of the pressing member for engaging with the object and for centering the pressing member to the housing of the object and for allowing the pressing member to be rotated relative to the support lever and the object, and two connecting levers each including an inner end portion having a tongue for engaging with the element, and each including an outer end portion engageable through the outer opening and into the channel of the support lever, and each including an enlarged head formed and provided on the outer end portion thereof for engaging with the support lever and for anchoring the support lever to the element and the housing of the object, and for allowing the element to be pulled and removed from the housing of the object when the pressing member is rotated relative to the housing of the object and the element, and for easily and quickly removing or disengaging the bearing element from the housing of the vehicle part or machine element or object when required, the connecting levers may be suitably and selectively attached or mounted or secured or coupled to the oil seals or the bearing elements of different sizes or dimensions or widths.

The center member includes a notch formed thereon for engaging with a projection of the object and for anchoring or positioning or retaining the center member and the pressing member to the object.

The pressing member includes an outer end portion having non-circular engaging member provided thereon for being engaged with a driving member which may drive or rotate the pressing member relative to the support lever.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
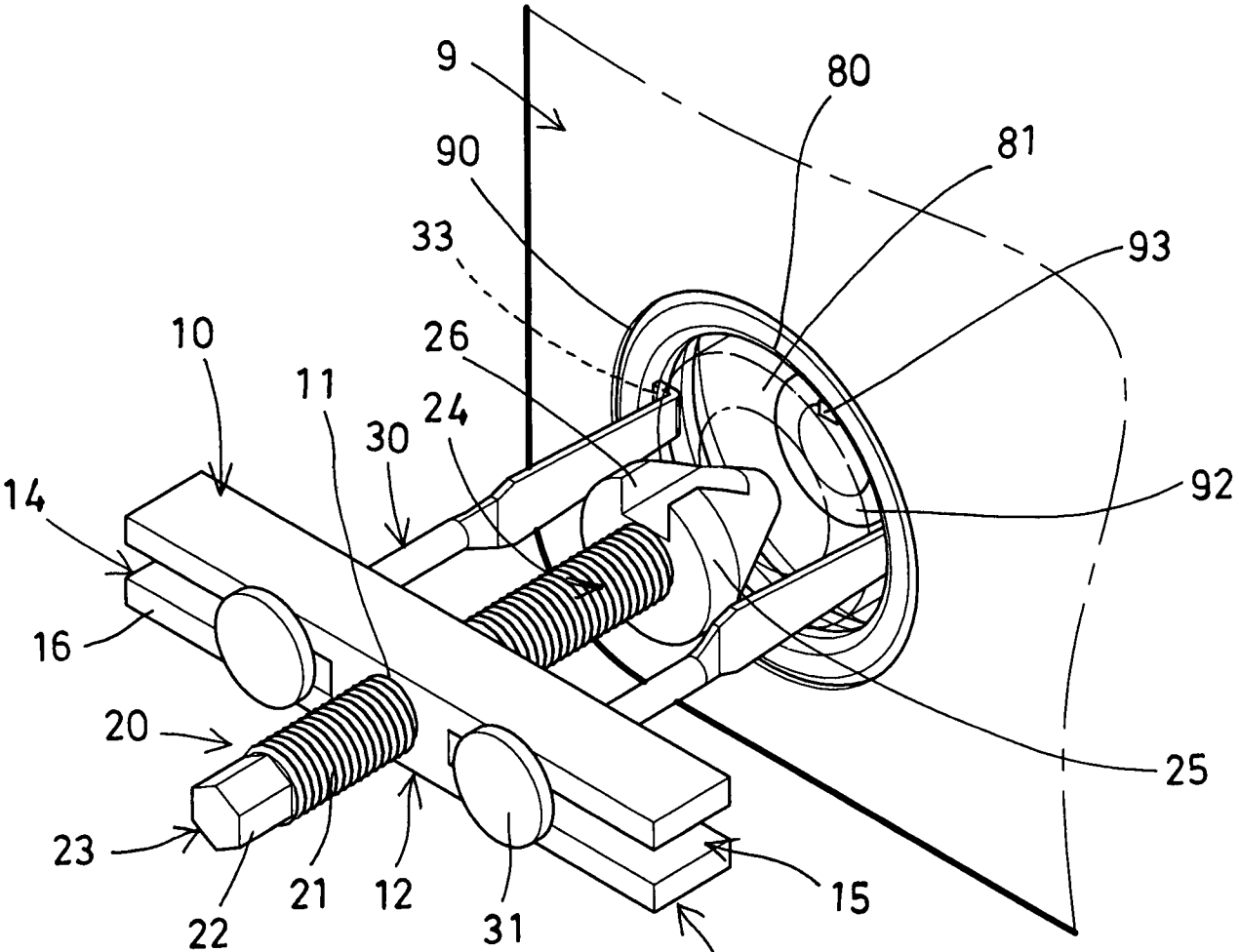
FIG. 1 is a partial perspective view illustrating the operation of a tool device in accordance with the present invention.
Figure 2:
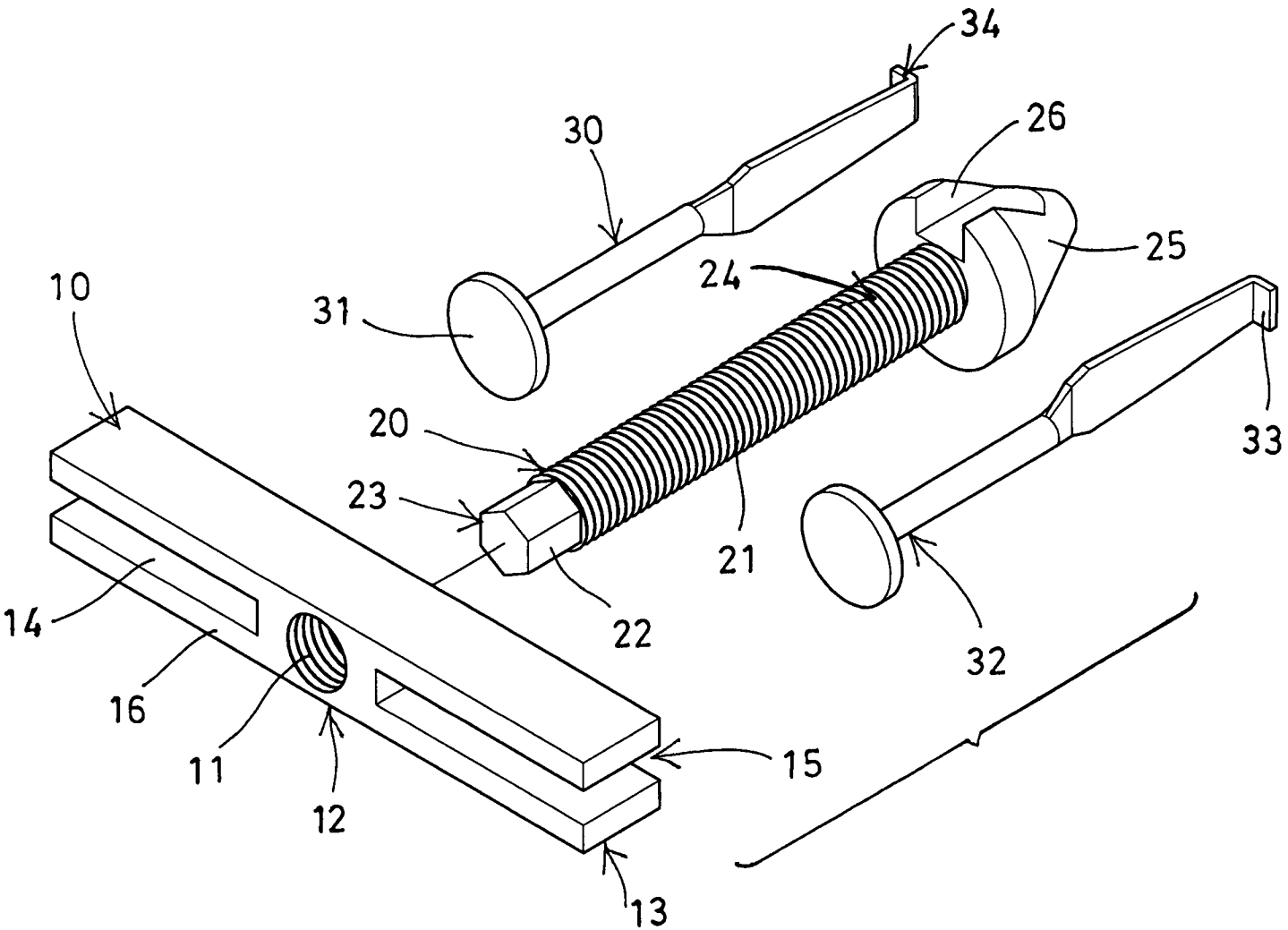
FIG. 2 is an exploded view of the tool device.
Figure 3:
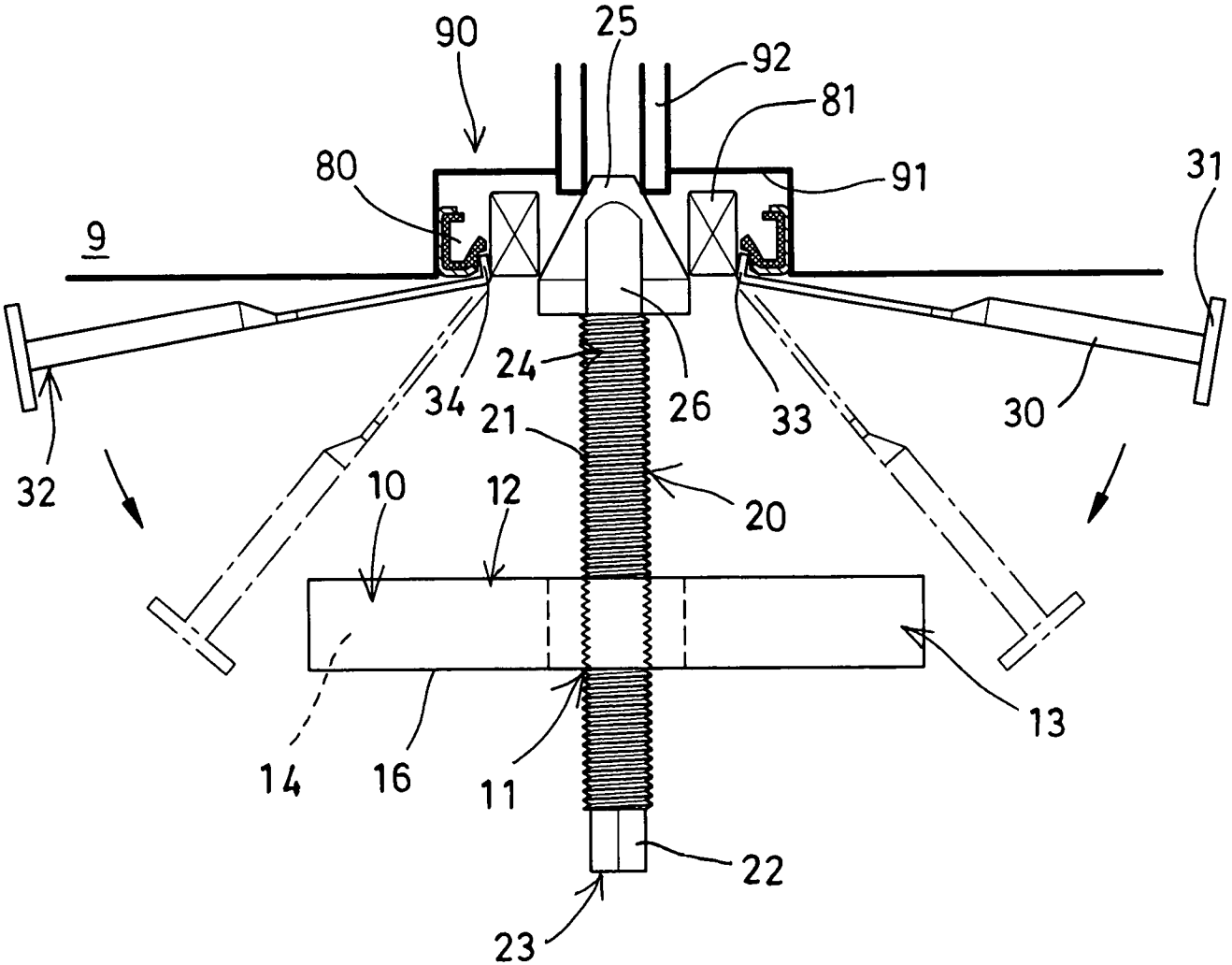
FIG. 3 is a side plan schematic view of the tool device.

Referring to the drawings, and initially to FIGS. 1-3, a tool device in accordance with the present invention is provided for dismantling or disengaging an oil seal 80 and/or a bearing element 81 from a socket or housing 90 of a vehicle part or machine element or object 9 which includes a chamber 91 formed therein for receiving or engaging with the oil seal 80 and/or the bearing element 81 and which includes an axle or tube or spindle 92 having a key or projection 93 extended therefrom (FIG. 1), and the tool device in accordance with the present invention is particularly provided for separating or dismantling or disengaging the oil seal 80 and/or the bearing element 81 from the socket or housing 90 of the vehicle part or machine element or object 9.

The tool device comprises a support lever 10 including an inner thread or screw hole 11 formed or provided on the middle portion 12 thereof, and including two end or side portions 13 each having an oblong hole or channel 14 formed therein and opened outwardly for forming an outer opening 15, and the support lever 10 includes a seat or outer engaging surface 16 formed or provided on the outer portion thereof that is located distal to the vehicle part or machine element or object 9 (FIGS. 1 and 3-5).

A pressing member 20 includes an outer thread 21 formed thereon for threading or engaging with the inner thread or screw hole 11 of the support lever 10 and for moving or adjusting relative to the support lever 10, and includes a non-circular engaging member 22 formed or provided on the outer end portion 23 thereof for being engaged with a driving member (not shown) which may drive or rotate the pressing member 20 relative to the support lever 10, and the pressing member 20 includes a center member 25 pivotally or rotatably attached or mounted or coupled to the other or inner end portion 24 thereof for contacting or engaging with the spindle 92 of the object 9 and for centering the pressing member 20 to the housing 90 of the object 9.

As shown in FIGS. 1 and 2, the center member 25 includes a notch 26 formed thereon for receiving or engaging with the key or projection 93 of the spindle 92 or of the object 9 and for anchoring or positioning or retaining the center member 25 to the spindle 92 or the object 9 and for allowing the pressing member 20 to be suitably pivoted or rotated relative to the object 9 and the oil seal 80 and/or the bearing element 81, and thus for allowing the support lever 10 to be suitably or smoothly moved or adjusted toward or away from the object 9.

Two linking or connecting or coupling members or levers 30 each include an enlarged head 31 formed or provided on one end or outer end portion 32 thereof for selectively engaging with the outer engaging surface 16 of the support lever 10, and each include a pawl or jaw or finger or tongue 33 formed or provided on the other end or inner end portion 34 thereof for selectively engaging with the oil seal 80 or the bearing element 81 and for selectively separating or dismantling or disengaging the oil seal 80 and/or the bearing element 81 from the socket or housing 90 of the vehicle part or machine element or object 9. The one end or outer end portion 32 of the connecting lever 30 is movable or engageable into the channel 14 of the support lever 10 from the outer opening 15 of the channel 14 of the support lever 10 for allowing the connecting levers 30 to be suitably and selectively attached or mounted or secured or coupled to the oil seals 80 or the bearing elements 81 of different sizes or dimensions or widths.

Figure 4:
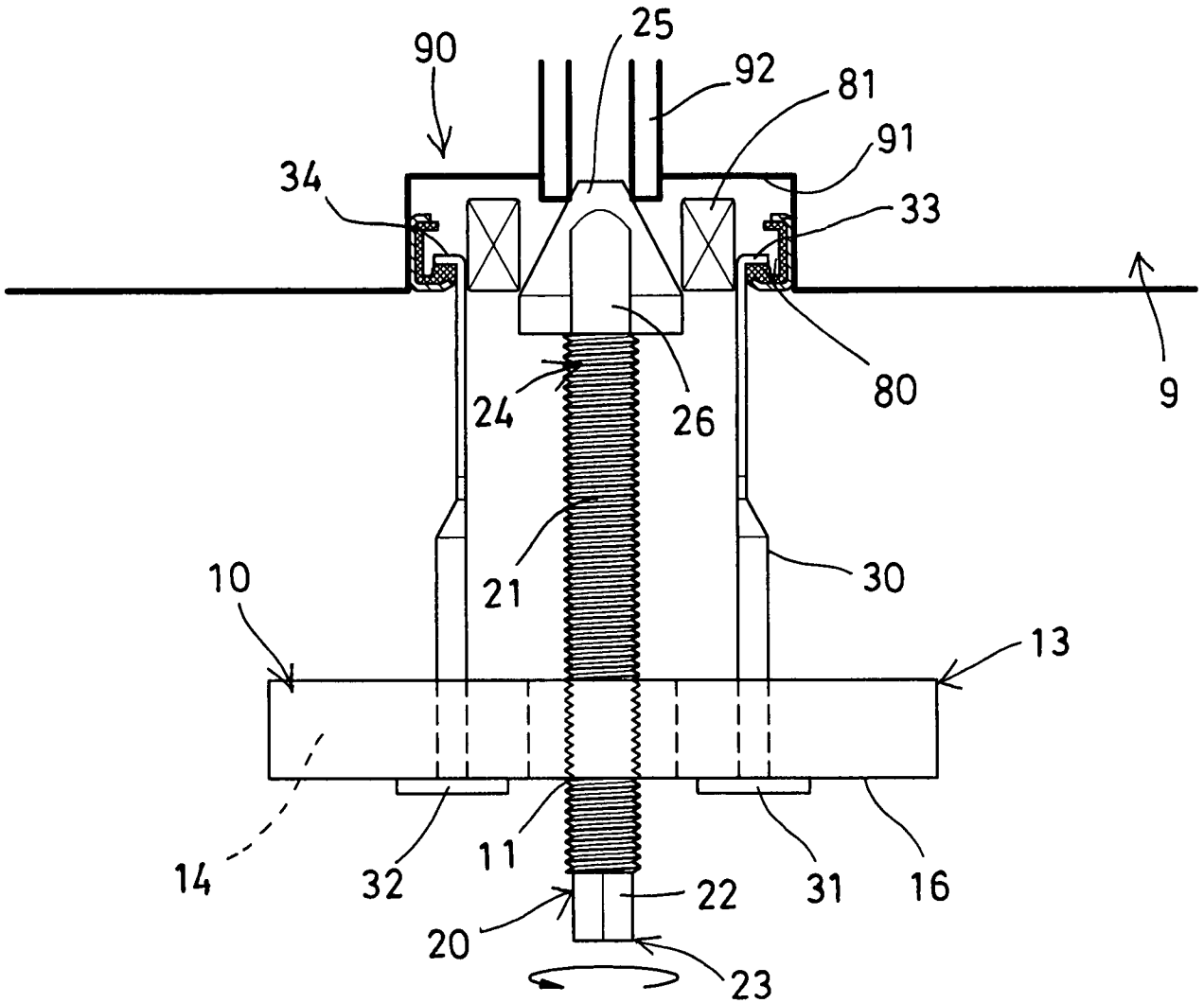
FIGS. 4, 5 are side plan schematic views similar to FIG. 3, illustrating the operation of the tool device.
Figure 5:
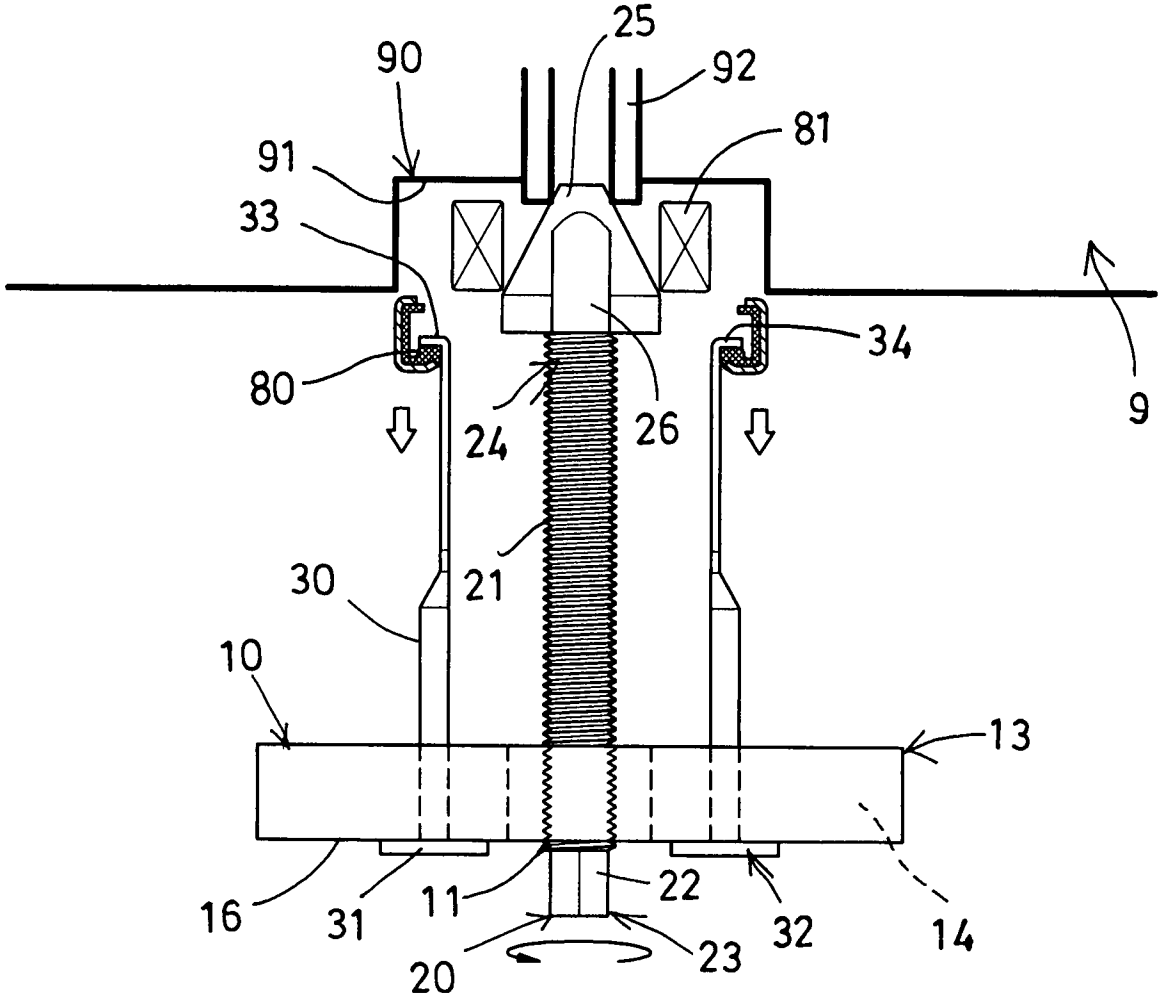

In operation, as shown in FIGS. 3-5, the tongues 33 of the connecting levers 30 may be suitably and selectively attached or mounted or secured or coupled to the oil seals 80 or the bearing elements 81 of different sizes or dimensions or widths, and the outer end portions 32 of the connecting levers 30 may be moved or engaged through the outer opening 15 and into the channel 14 of the support lever 10 for coupling the support lever 10 to the oil seal 80 or the bearing element 81 or the socket or housing 90 of the vehicle part or machine element or object 9, and the pressing member 20 may then be driven or rotated relative to the support lever 10 to pull or to remove or disengage the oil seal 80 or the bearing element 81 from the housing 90 of the vehicle part or machine element or object 9.

Accordingly, the tool device in accordance with the present invention may be provided for easily and quickly pulling or removing or disengaging the bearing elements from the sockets or housings of the vehicle parts or machine elements or objects when required, or when the sockets or housings or the bearing elements include different sizes or dimensions or widths.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool device for dismantling an element from a housing of an object, said tool device comprising:

a support lever including a middle portion having a screw hole formed therein, and including two side portions each having a channel formed therein and opened outwardly for forming an outer opening, a pressing member including an outer thread for engaging with said screw hole of said support lever and including an inner end portion, a center member pivotally attached to said inner end portion of said pressing member for engaging with the object and for centering said pressing member to the housing of the object and for allowing said pressing member to be rotated relative to said support lever and the object, two connecting levers each including an inner end portion having a tongue for engaging with the element, and each including an outer end portion engageable through said outer opening and into said channel of said support lever, and each including an enlarged head formed and provided on said outer end portion thereof for engaging with said support lever and for anchoring said support lever to the element and the housing of the object, and for allowing the element to be pulled and removed from the housing of the object when said pressing member is rotated relative to the housing of the object and the element, and wherein said center member includes a notch formed thereon for engaging with a projection of the object.

2. The tool device as claimed in claim 1, wherein said pressing member includes an outer end portion having non-circular engaging member provided thereon.

* * * * *